US007445240B2

(12) United States Patent
Ichimura et al.

(10) Patent No.: US 7,445,240 B2
(45) Date of Patent: Nov. 4, 2008

(54) DRIVE DEVICE OF HYDRAULIC CYLINDER FOR WORKING

(75) Inventors: Kazuhiro Ichimura, Niihari-gun (JP); Katsuaki Kodaka, Tsuchiura (JP); Hidetoshi Satake, Ishioka (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 444 days.

(21) Appl. No.: 10/540,856

(22) PCT Filed: Dec. 27, 2002

(86) PCT No.: PCT/JP02/13830

§ 371 (c)(1),
(2), (4) Date: Jun. 27, 2005

(87) PCT Pub. No.: WO2004/061312

PCT Pub. Date: Jul. 22, 2004

(65) Prior Publication Data

US 2006/0123672 A1 Jun. 15, 2006

(51) Int. Cl.
*B60S 9/10* (2006.01)

(52) U.S. Cl. ..... 280/766.1; 280/763.1; 180/41

(58) Field of Classification Search ..... 280/763.1, 280/764.1, 765.1, 766.1; 180/41
See application file for complete search history.

(56) References Cited

U.S. PATENT DOCUMENTS

| | | | |
|---|---|---|---|
| 3,922,855 | A | 12/1975 | Bridwell et al. |
| 4,087,968 | A | 5/1978 | Bianchetta |
| 4,124,226 | A | 11/1978 | Phillips |
| 4,296,773 | A | 10/1981 | Harshman et al. |
| 4,416,344 | A | 11/1983 | Nakada |
| 5,159,989 | A | 11/1992 | Claxton |

(Continued)

FOREIGN PATENT DOCUMENTS

| | | | |
|---|---|---|---|
| DE | 1 634 769 | A1 | 9/1970 |

(Continued)

OTHER PUBLICATIONS

Microfilm of the specification and drawings annexed to the request of Japanese Utility Model application No. 171367/1984 (Laid-open No. 85559/1986) (Hitachi Construction Machinery Co., Ltd.) Jun. 5, 1986.

(Continued)

*Primary Examiner*—Christopher Ellis
*Assistant Examiner*—John D Walters
(74) *Attorney, Agent, or Firm*—Crowell & Moring LLP

(57) ABSTRACT

The present invention includes a hydraulic source (28), at least a plurality of work hydraulic cylinders (11) of a single type, that are to be driven with pressure oil from the hydraulic source (28), a control valve (22) that controls a flow of pressure oil from the hydraulic source (28) to the work hydraulic cylinders (11), an operating means for (26) issuing a command for drive of the control valve (22), a selector switch (41, 42) that selects at least an independent operation of the work hydraulic cylinders (11), and a pressure oil control means (12*a*, 12*b*, 34 to 37) for allowing the pressure oil to flow to a work hydraulic cylinder (11) selected with the selector switch (41, 42) and disallowing flow of pressure oil to other work hydraulic cylinders (11).

7 Claims, 10 Drawing Sheets

U.S. PATENT DOCUMENTS 6,954,150 B2 * 10/2005 Nishimura et al. ..... 340/685

FOREIGN PATENT DOCUMENTS

| | | | |
|---|---|---|---|
| DE | 2 238 168 | A1 | 2/1974 |
| EP | 1 584 824 | A1 | 10/2005 |
| FR | 2 616 201 | A | 12/1988 |
| GB | 2 351 274 | A | 12/2000 |
| JP | 53-43321 | A | 4/1978 |
| JP | 53-107795 | U | 9/1978 |
| JP | 56-160239 | A | 12/1981 |
| JP | 60-191584 | U | 12/1985 |
| JP | 61-85559 | U | 5/1986 |
| JP | 63-4772 | U | 1/1988 |
| JP | 64-24163 | U | 2/1989 |
| JP | 1-103466 | A | 4/1989 |
| JP | 1-103466 | U | 7/1989 |
| JP | 01-309859 | A | 12/1989 |
| JP | 2-33162 | U | 3/1990 |
| JP | 02-074446 | | 3/1990 |
| JP | 2-89051 | U | 7/1990 |
| JP | 03-008932 | A | 1/1991 |
| JP | 5-52302 | U | 7/1993 |
| JP | 6-8460 | U | 2/1994 |
| JP | 6-24203 | U | 3/1994 |
| JP | 6-25603 | U | 4/1994 |
| JP | 8-270608 | A | 10/1996 |
| JP | 9-316934 | A | 12/1997 |
| JP | 11-092085 | A | 4/1999 |
| JP | 11-255015 | A | 9/1999 |
| JP | 2002-081409 | A | 3/2002 |
| WO | WO 2004/061313 | A1 | 7/2004 |

OTHER PUBLICATIONS

Microfilm of the specification and drawings annexed to the request of Japanese Utility Model Application No. 98633/1986 (Laid-open No. 4772/1988) (Hitachi Construction Machinery Co., Ltd.) Jan. 13, 1988.

Microfilm of the specification and drawings annexed to the request of Japanese Utility Model Application No. 166453/1988 (Laid-open No. 89051/1990) (Yutani Heavy Industries, Ltd), Jul. 13, 1990.

International Search Report for PCT/JP02/13830 dated Apr. 30, 2003 (two (2) pages).

International Search Report dated Apr. 30, 2003 ((Two (2) pages).

Supplementary European Search Report dated Dec. 19, 2007 (Three (3) pages).

Japanese office action dated May 1, 2008, with English translation.

* cited by examiner

DRIVE DEVICE OF HYDRAULIC CYLINDER FOR WORKING

Cross-reference is hereby made to U.S. patent application Ser. No. 10/540,987, now U.S. Pat. No. 7,197,872, issued Apr. 3, 2007, which is the U.S. national phase of international PCT application PCT/JP02/13831, filed Dec. 27, 2002.

TECHNICAL FIELD

The present invention relates to a drive device of work hydraulic cylinders, which enables selective operations of a plurality of work hydraulic cylinders such as outrigger cylinders mounted at a work vehicle.

BACKGROUND ART

Hydraulic circuits used for outrigger cylinders in the related art include, for instance, the hydraulic circuit disclosed in Japanese Laid Open utility Model Publication No. S63-4772.

In the hydraulic circuit disclosed in this publication, the bottom chambers or the rod chambers of outrigger cylinders disposed to the front, the rear, the left and the right sides of the vehicle are made to communicate individually via a hydraulic pilot switching valve. In response to a switching operation at the switching valve, pressure oil is allowed to flow to a desired hydraulic cylinder while cutting off the flow of pressure oil to the other hydraulic cylinders. This system makes it possible to operate the outriggers on the front side, the rear side, the left side and the right side independently of one another.

The operation that needs to be performed to select a specific outrigger in the circuit having outriggers that can be operated independently of one another tends to be complicated.

DISCLOSURE OF THE INVENTION

An object of the present invention is to provide a drive device of work hydraulic cylinders that facilitates a selection operation.

A drive device of work hydraulic cylinders according to the present invention includes a hydraulic source, at least a plurality of work hydraulic cylinders of a single type, that are to be driven with pressure oil from the hydraulic source, a control valve that controls a flow of pressure oil from the hydraulic source to the work hydraulic cylinders, an operating means for issuing a command for drive of the control valve, a selector switch that selects at least an independent operation of the work hydraulic cylinders, and a pressure oil control means for allowing the pressure oil to flow to a work hydraulic cylinder selected with the selector switch and disallowing flow of pressure oil to other work hydraulic cylinders.

In this manner, an independent operation of the work hydraulic cylinders and a simultaneous operations of a plurality of work hydraulic cylinders can be selected with the selector switch, which facilitates an operation to select a specific work hydraulic cylinder.

Outrigger cylinders may be mounted on a left side and a right side of a vehicle and the selector switch may select operations of outrigger cylinders. All the outrigger cylinders can be set in a non-operating state with the selector switch.

Operations of the work hydraulic cylinders may be selected with a switching means. An operation-enabled work hydraulic cylinder may be put up on a display.

Alternatively, a drive device of work hydraulic cylinders according to the present invention includes a hydraulic source, outrigger cylinders mounted at front and rear of a vehicle on a left side and a right side, that are to be driven with pressure oil from the hydraulic source, a control valve that controls a flow of pressure oil from the hydraulic source to the outrigger cylinders, an operating means for issuing a command for drive of the control valve, a first selector switch that selects an independent operation of one of a left-side outrigger cylinder and a right-side outrigger cylinder or simultaneous operations of the left-side outrigger cylinder and the right-side outrigger cylinder, a second selector switch that selects an independent operation of one of a front-side outrigger cylinder and a rear-side outrigger cylinder or simultaneous operations of the front-side outrigger cylinder and the rear-side outrigger cylinder, and a pressure oil control means for allowing the pressure oil to flow to an outrigger cylinder selected with the first selector switch and the second selector switch and disallowing flow of the pressure oil to other outrigger cylinders.

In this manner, it is possible to alternately extend/contract outrigger cylinders through switch operations with ease.

BEST MODE FOR CARRYING OUT THE INVENTION

The following is an explanation of the embodiments achieved by adopting a drive device according to the present invention in a wheel hydraulic excavator, given in reference to FIGS. 1 to 10.

Figure 1:
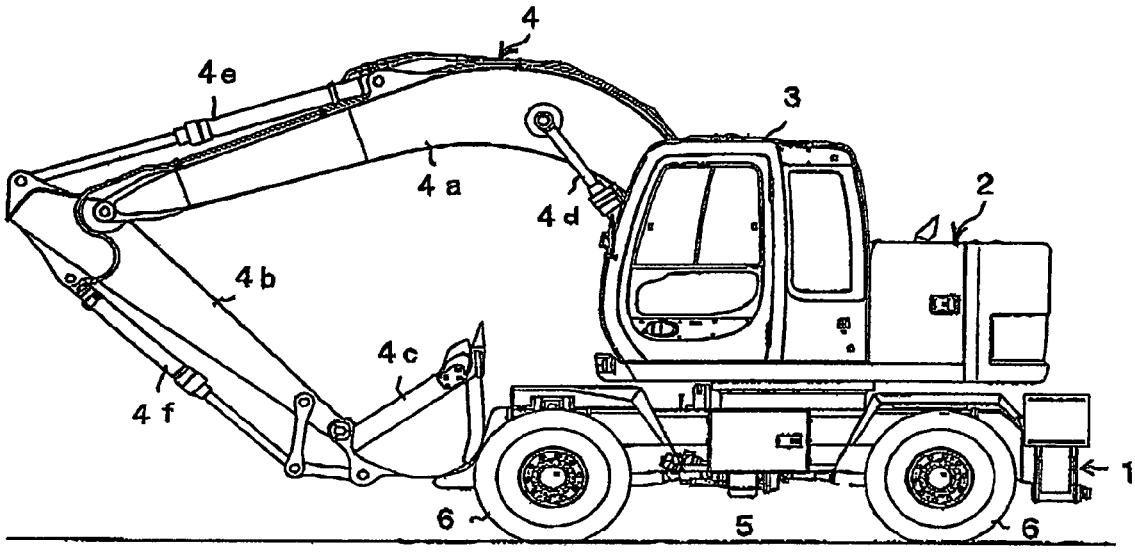
FIG. 1 is an external view of a wheel hydraulic excavator in which the present invention is adopted.

As shown in FIG. 1, a wheel hydraulic excavator includes an undercarriage 1 and a revolving upperstructure 2 rotatably mounted atop the undercarriage 1. An operator's cab 3 and a work front attachment 4 constituted with a boom 4*a*, an arm 4*b* and a bucket 4*c* are disposed at the revolving upperstructure 2. The boom 4*a* is hoisted as a boom cylinder 4*d* is driven, the arm 4*b* is hoisted as an arm cylinder 4*e* is driven and the bucket 4*c* is engaged in a lift operation or a dump operation as a bucket cylinder 4*f* is driven. A traveling motor 5, which is hydraulically driven, is disposed at the undercarriage 1, and the rotation of the traveling motor 5 is transmitted to wheels 6 (tires) via a drive shaft and axles.

Figure 2:
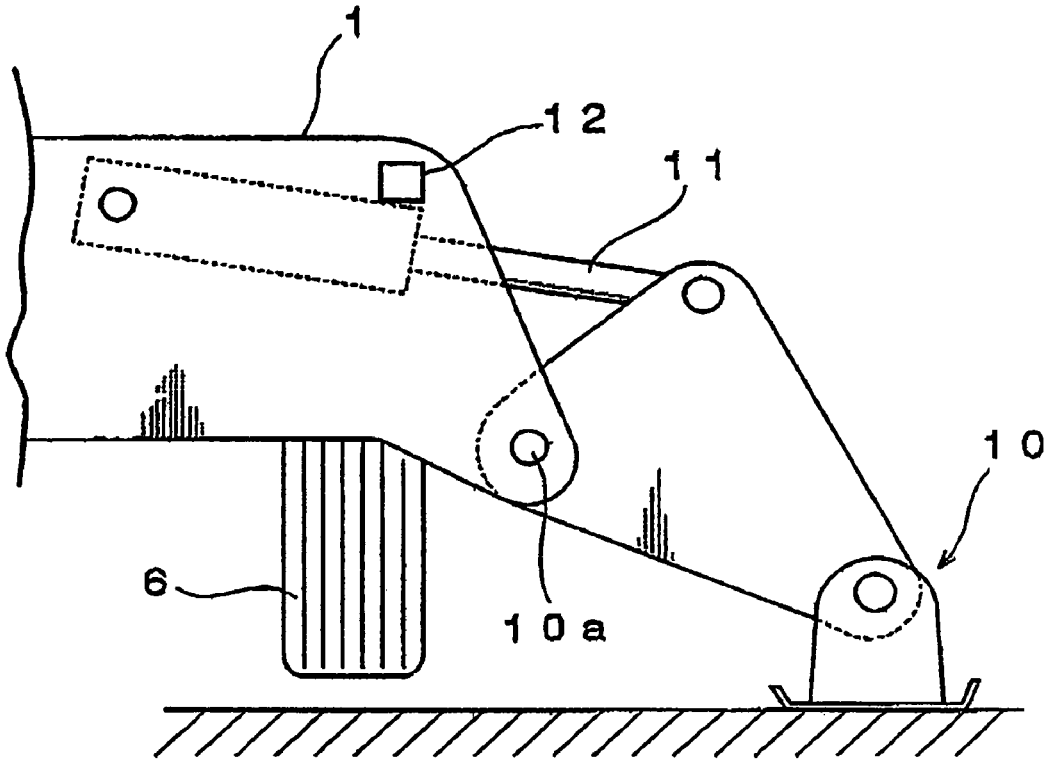
FIG. 2 is an enlargement of an essential part of FIG. 1.

As shown in FIG. 2, an outrigger or stabilizer 10 is disposed near each of the tires 6 disposed at the front and the rear of the undercarriage 1 on the left and right sides. An outrigger cylinder 11 is attached to the outrigger 10 and as the cylinder 11 extends and contracts, the outrigger 10 rotates with a hinge pin 10*a* acting as its fulcrum. As the cylinder 11 extends, the outrigger 10 is lowered to the ground to lift the vehicle off the ground (jack up), and as the cylinder 11 contracts and retracts, the outrigger 10 is stored into the undercarriage 1, thereby lowering the vehicle onto the ground (jack down).

Figure 3:
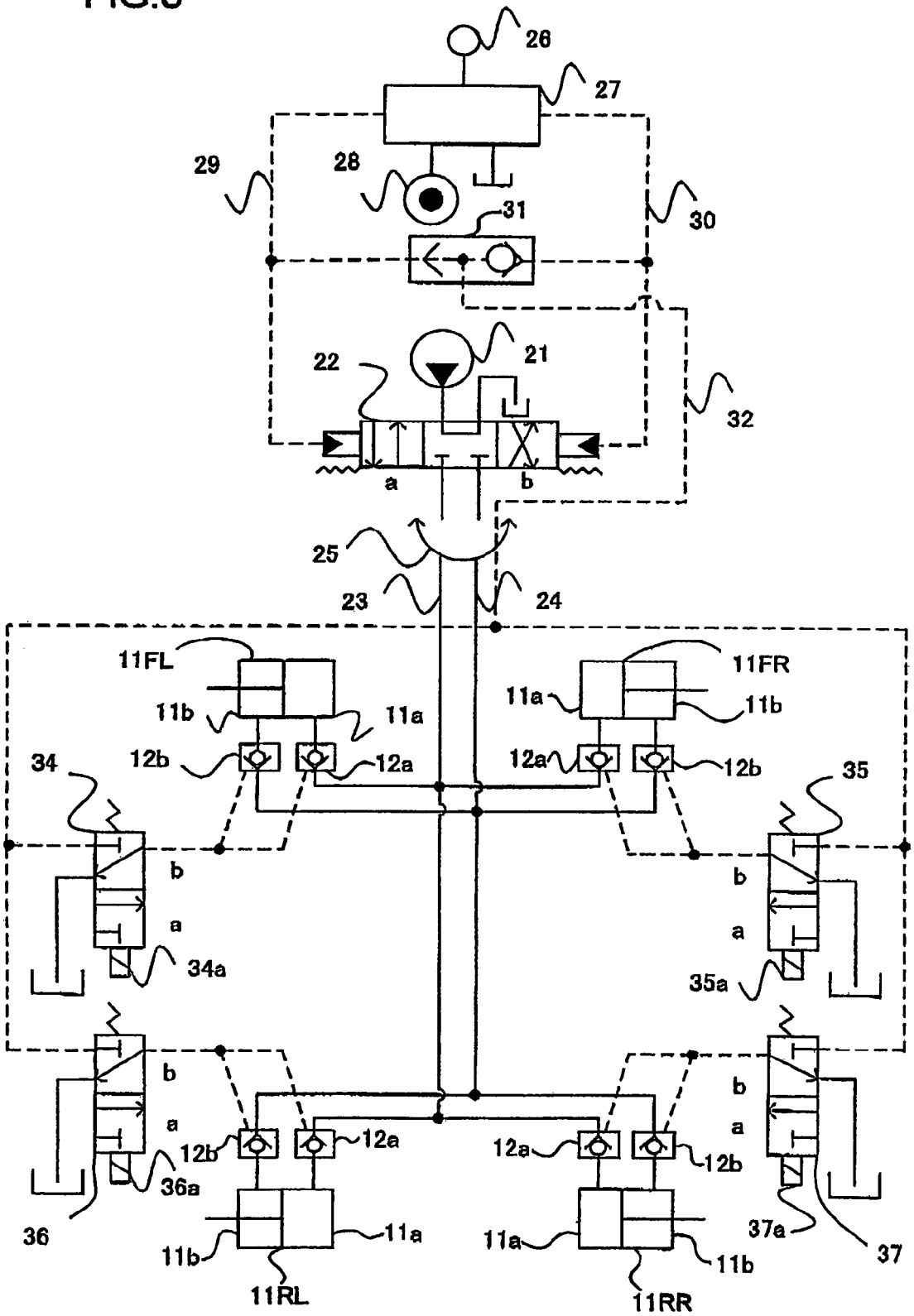
FIG. 3 is a hydraulic circuit diagram showing the structure of a drive device achieved in an embodiment of the present invention.

FIG. 3 is a diagram of a hydraulic circuit for driving the outrigger cylinders 11, achieved in an embodiment of the present invention. It is to be noted that reference numerals 11FL, 11FR, 11RL and 11RR respectively indicate the outrigger cylinders 11 at the front left, the front right, the rear left and the rear right of the vehicle.

In the circuit shown in FIG. 3, the pressure oil from a hydraulic pump 21 disposed at the revolving upperstructure 2 travels through a center joint 25 via a directional control valve 22 and a pipeline 23 or 24 and is guided to the undercarriage. The oil returning from the undercarriage 1 travels through the center joint 25 via the pipeline 24 or 23 and is guided to a reservoir.

The directional control valve 22 is switched in response to an operation of an operation lever 26. Namely, as the operation lever 26 is operated, a pressure-reducing valve 27 is driven in correspondence to the extent to which the operation lever is operated and a pilot pressure from a hydraulic source 28 is applied to a pilot port at the directional control valve 22 via a pilot pipeline 29 or 30, thereby switching the directional control valve 22. A shuttle valve 31 is disposed between the pilot pipelines 29 and 30, and the pilot pressure generated at the revolving upperstructure 2 is guided to the undercarriage 1 after passing through the center joint 25 via the shuttle valve 31 and a pilot pipeline 32.

Pilot-operated check valves 12*a* and 12*b* provided in correspondence to each cylinder are disposed on the intake side of a bottom chamber 11*a* and a rod chamber 11*b* of each of the outrigger cylinders 11FL, 11FR, 11RL and 11RR. The bottom chambers 11*a* communicate with one another via the pilot-operated check valves 12*a* and they also connect with the pipeline 23. The rod chambers 11*b* communicate with one another via the pilot-operated check valves 12*b* and they also connect with the pipeline 24.

The pilot 7 operated check valves 12*a* and 12*b* are controlled by a pilot pressure supplied from the outside. Pilot ports of the pilot-operated check valves 12*a* and 12*b* are connected to the pilot pipeline 32 via solenoid controlled directional control valves 34 to 37 provided in correspondence to the outrigger cylinders 11FL, 11FR, 11RL and 11RR respectively. Solenoids 34*a* to 37*a* of the solenoid controlled directional control valves 34 to 37 are excited or demagnetized in response to electrical signals output via, for instance, slip-rings from the revolving upperstructure side 2.

As the solenoids 34*a* to 37*a* become excited, the respective solenoid controlled directional control valves 34 to 37 are each switched to a position "a", and, as a result, the pilot pressure from the pilot pipeline 32 is applied to the pilot-operated check valves 12*a* and 12*b*. This invalidates the function of the pilot-operated check valves 12*a* and 12*b* as check valves and the pilot-operated check valves 12*a* and 12*b* are allowed to function simply as open valves, thereby allowing the pressure oil to flow out from the bottom chambers 11*a* and the rod chambers 11*b*.

As the solenoids 34*a* to 37*a* become demagnetized, the respective solenoid controlled directional control valves 34 to 37 are each switched to a position "b", thereby stopping the supply of the pilot pressure to the pilot-operated check valves 12*a* and 12*b*. As a result, the pilot-operated check valves 12*a* and 12*b* function as check valves and the flow of pressure oil out of the bottom chambers 11*a* and the rod chambers 11*b* becomes prohibited. Since the pilot-operated check valves 12*a* and 12*b* all adopt a structure having a poppet valve which becomes pressed against the surface of the main unit seat by the pressure generated in a reverse flow instead of a structure having a spool that moves within a valve unit as in a switching valve, hardly any leak occurs and the cost of such pilot-operated check valves can be kept low.

Figure 4:
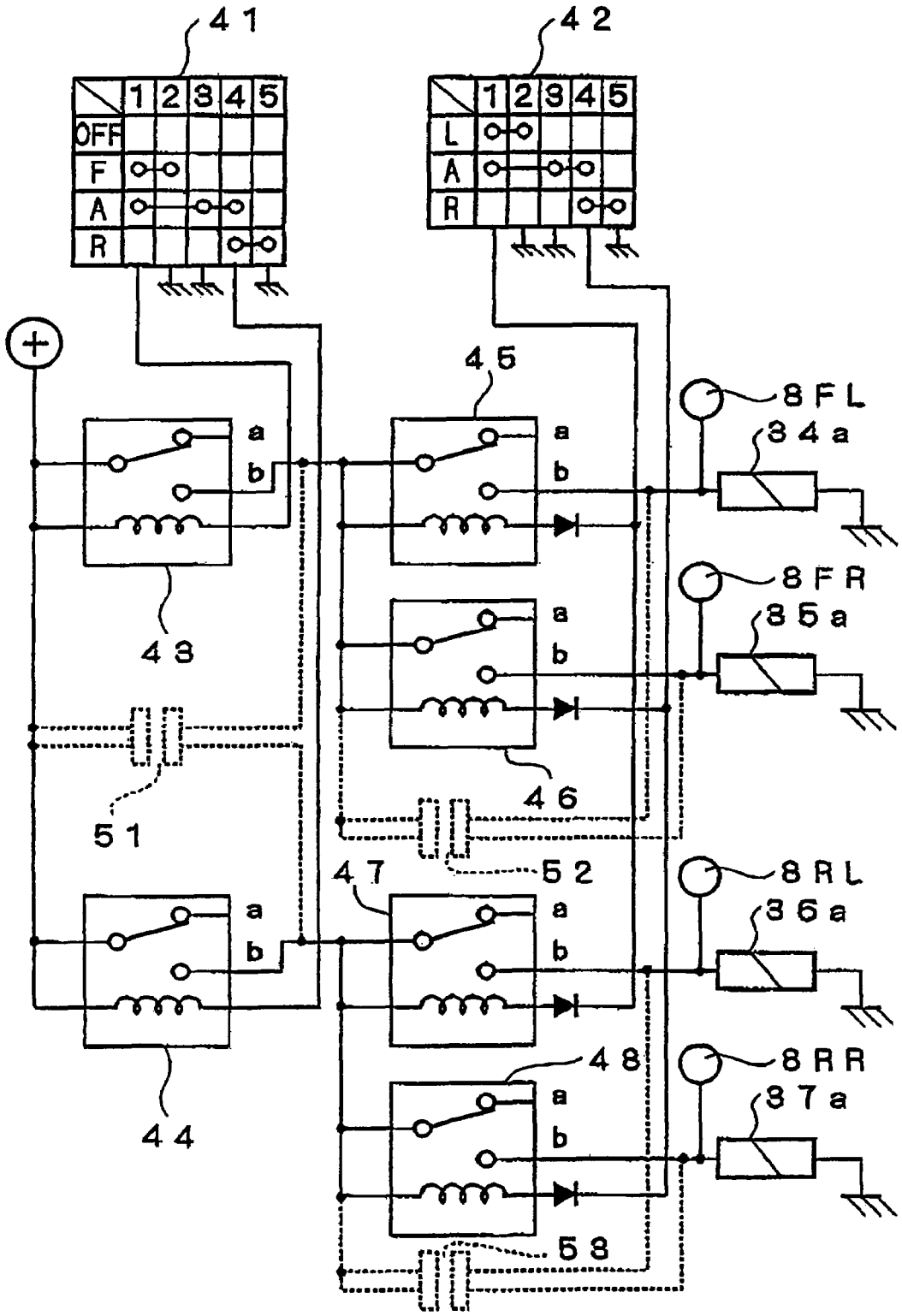
FIG. 4 shows a relay circuit that controls solenoid controlled directional control valves in FIG. 3.

FIG. 4 shows a relay circuit that controls the power supply to the solenoids 34*a* to 37*a*. This relay circuit is switched in response to operations of, for instance, a dial-type front/rear selector switch 41 and a dial-type left/right selector switch 42 shown in FIG. 5. The switches 41 and 42 are installed in the operator's cab 3.

Figure 5:
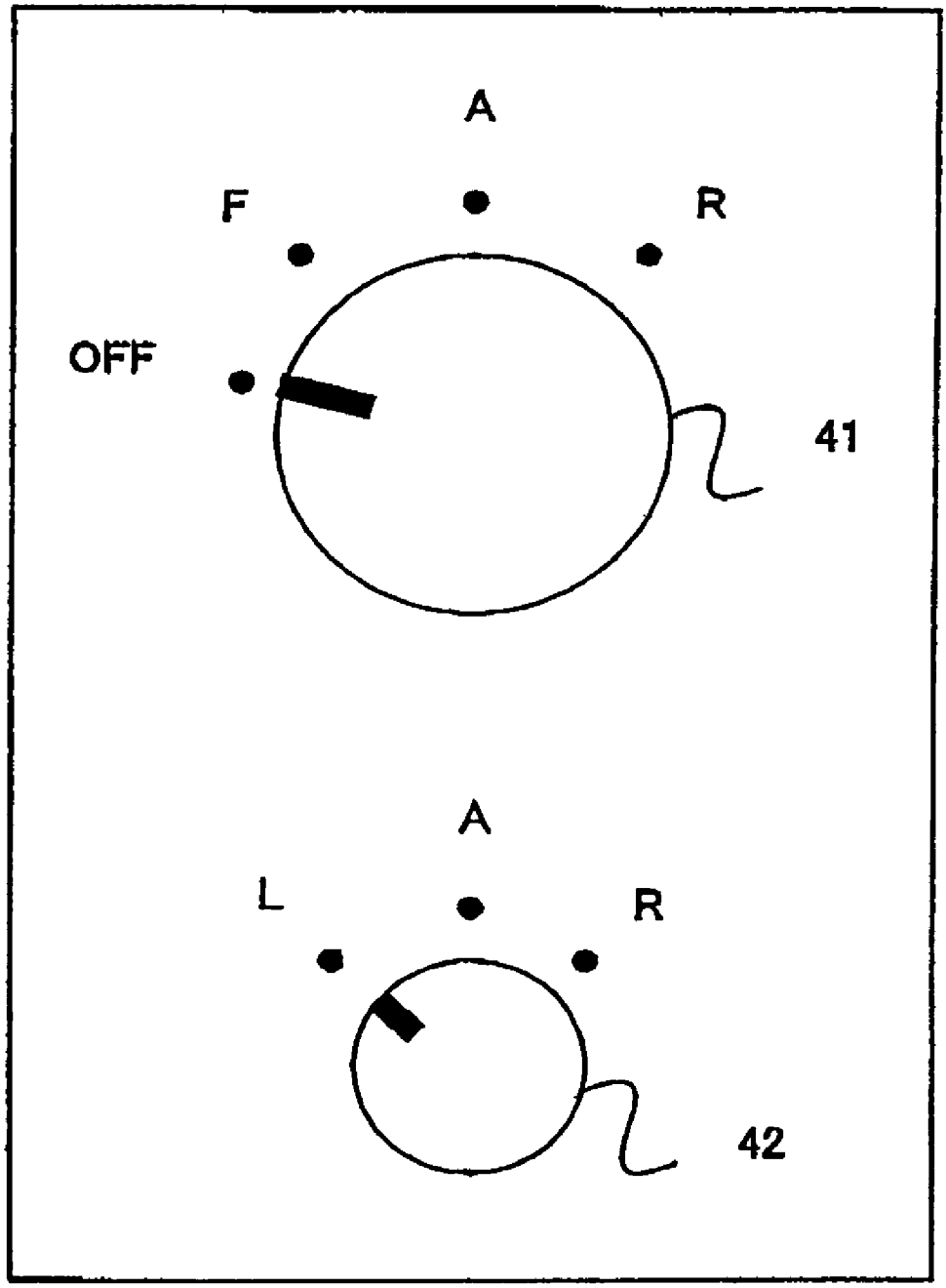
FIG. 5 shows an operating member through which control commands for the solenoid controlled directional control valves are output.

As shown in FIG. 5, the front/rear selector switch 41 can be operated to an OFF position, an F position; an A position or an R position to selectively operate the outrigger cylinders 11FL and 11FR on the front side and the outrigger cylinders 11RL and 11RR on the rear side. Namely, the switch 41 is operated to the F position to drive the front-side cylinders 11FL and 11FR, is operated to the R position to drive the rear-side cylinders 11RL and 11RR, is operated to the A position to drive the cylinders 11FL, 11FR, 11RL and 11RR on both the front side and the rear side and is operated to the OFF position if none of the cylinders 11FL, 11FR, 11RL and 11RR is to be driven.

The left/right selector switch 42, which can be operated to an L position, an A position or an R position, is used to selectively operate the outrigger cylinders 11FL and 11RL and the outrigger cylinders 11FR and 11RR on the left side and the right side. Namely, the switch 42 is operated to the L position to drive the left-side cylinders 11FL and 11RL, is operated to the R position to drive the right-side cylinders 11FR and 11R and is operated to the A position to drive the cylinders 11F, 11FR, 11RL and 11RR on both the left side and the right side.

Through the switch operations described above, an allow extension/contraction command or a prohibit extension/contraction command is output to each of the outrigger cylinders 11FL, 11FR, 11RL and 11RR.

Figure 6:
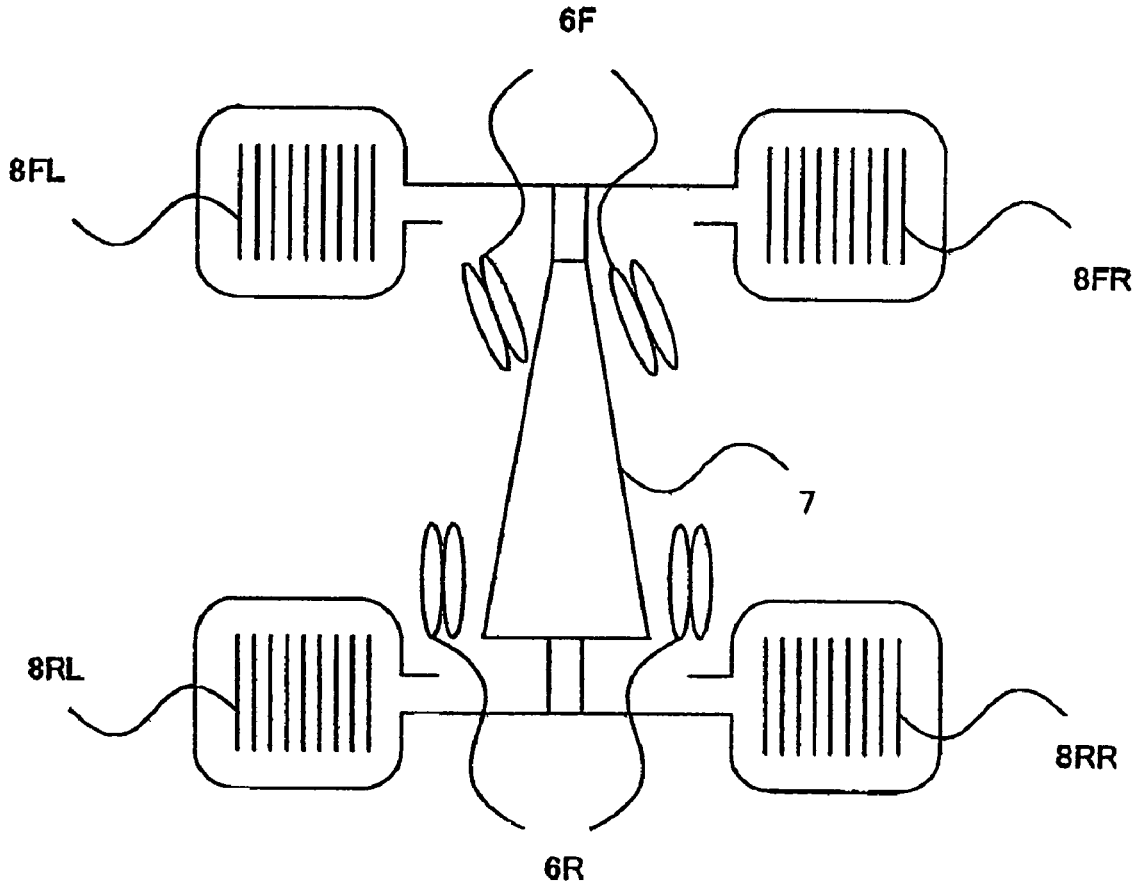
FIG. 6 presents an example of a display brought up to indicate operation-enabled outrigger cylinders.

Each operation-enabled outrigger cylinder 11 selected with the switches 41 and 42 is indicated at a display unit inside the operator's cab 3. FIG. 6 shows an example of such a display. It is to be noted that the figure shows the undercarriage 1 in a simplified form, with reference numeral 6F indicating the front tires, reference numeral 6R indicating the rear tires and reference numeral 7 indicating the undercarriage frame. Lamps 8FL, 8FR, 8RL and 8RR are disposed at the display unit, in correspondence to the front and rear outrigger cylinders 11FL, 11R, 11RL and 11RR mounted on the left and right sides. As an operation of a given outrigger cylinder 11 is selected, the corresponding lamp among the lamps 8FL, 8FR, 8RL and 8RR becomes lit, as detailed later, so as to indicate the operation-enabled outrigger cylinder 11 to the operator. In the figure, the front tires 6F are in a steered state, with the undercarriage frame 7 shown in a substantially trapezoidal shape with the front side thereof having a smaller width. Accordingly, even after the revolving upperstructure 2 rotates, the operator is able to distinguish the front and rear outrigger cylinders 11 on the left and right sides from one another with ease.

The relay circuit in FIG. 4 is now explained. If the front/rear selector switch 41 in FIG. 4 is operated to the OFF position, no power is supplied to coils at relays 43 and 44 and, as a result, the relays 43 and 44 are each switched to a contact point "a". Consequently, the solenoids 34*a* to 37*a* are all demagnetized. As the front/rear selector switch 41 is operated to the F position, terminals 1 and 2 at the switch 41 come into communication with each other as shown in the figure and power is thus supplied to the coil at the relay 43, thereby switching the relay 43 to a contact point "b". As the front/rear selector switch 41 is operated to the R position, switch terminals 4 and 5 come into communication with each other and thus, power is supplied to the coil at the relay 44 to switch the relay 44 to a contact point "b". As the front/rear selector switch 41 is operated to the A position, the switch terminals 1, 3 and 4 come into communication with one another, and power is thus supplied to the coils at the relays 43 and 44, thereby switching both the relays 43 and 44 to their contact points "b".

If the left/right selector switch 42 is operated to the L position after the relay 43 is switched to the contact point "b", terminals 1 and 2 at the switch 42 come into communication with each other, as shown in the figure, power is supplied to a coil at a relay 45, thereby switching the relay 45 to a contact point "b". As a result, the solenoid 34*a* becomes excited and the lamp 8FL is turned on. If the left/right selector switch 42 is operated to the R position, switch terminals 4 and 5 come into communication with each other and power is thus supplied to a coil at a relay 46, thereby switching the relay 46 to a contact point "b". Consequently, the solenoid 35*a* becomes excited and the lamp 8FR is turned on. If the left/right selector switch 42 is operated to the A position, the switch terminals 1, 3 and 4 come into communication with one another and power is thus supplied to the coils at the relays 45 and 46, thereby switching both the relays 45 and 46 to their contact points "b". As a result, the solenoids 34*a* and 35*a* are both excited, turning on the lamps 8FL and 8FR.

If the left/right selector switch 42 is operated to the L position after the relay 44 is switched to the contact point "b", the switch terminals 1 and 2 come into communication with each other and power is supplied to a coil at a relay 47, thereby switching the relay 47 to a contact point "b". As a result the solenoid 36*a* becomes excited and the lamp 8RL is turned on. If the left/right selector switch 42 is operated to the R position, the switch terminals 4 and 5 come into communication with each other and power is supplied to a coil at a relay 48, thereby switching the relay 48 to a contact point "b". Consequently, the solenoid 37*a* becomes excited and the lamp 8RR is turned on. If the left/right selector switch 42 is operated to the A position, the switch terminals 1, 3 and 4 come into communication with one another and power is thus supplied to the coils at the relays 47 and 48, thereby switching both the relays 47 and 48 to their contact points "b". As a result, the solenoids 36*a* and 37*a* become excited, thereby turning on the lamps 8RL and 8RR.

Switches 51, 52 and 53 are disposed in the relay circuit so as to respectively bypass the pair of relays 43 and 44, the pair of relays 45 and 46 and the pair of relays 47 and 48. As the switches 51 to 53 are turned on, the terminals at the relays 43 through 48 at the two sides thereof become short-circuited, which makes it possible to excite the solenoids 34*a* to 37*a* without operating the switches 41 and 42. The switches 51 to 53 are turned on as connectors are connected and are turned off as the connectors become disconnected. It is to be noted that the switches 51 to 53 are in an OFF state in FIG. 4.

Next, the operation that characterizes the embodiment is explained.

When the vehicle body is not to be jacked up or down (hereafter referred to as jack up/down) the front/rear selector switch 41 is operated to the OFF position. In response to this switch operation, a prohibit extension/contraction command for all the outrigger cylinders 11 is output, and the solenoids 34*a* to 37*a* are all demagnetized as described earlier, setting the lamps 8FL, 8FR, 8RL and 8RR in an OFF state. As a result, the individual solenoid controlled directional control valves 34 to 37 are switched to the position b and the communication of the pilot-operated check valves 12*a* and 12*b* with the pilot pipeline 32 becomes cut off. Thus, the pilot-operated check valves 12*a* and 12*b*, with no pilot pressure supplied thereto function as check valves. In this state, even if the directional control valve 22 is switched and pressure oil is guided from the hydraulic pump 21 to the outrigger cylinders 11, the pressure oil is not allowed to flow out of the bottom chambers 11*a* and the rod chambers 11*b* and the cylinders 11 cannot be extended. In other words, the operations of all the outrigger cylinders 11 are prohibited.

In order to jack up/down the entire vehicle body, the front/rear selector switch 41 and the left/right selector switch 42 are each operated to the A position. Through these switch operations, an allow extension/contraction command is output for all the outrigger cylinders 11, the solenoids 34*a* to 37*a* become excited and the lamps 8FL, 8FR, 8RL and 8RR are turned on. In response, the solenoid controlled directional control valves 34 to 37 are all switched to the position "a".

As the operation lever 26 is operated to A side or B side in this state, the pilot pressure from the hydraulic source 28 is applied to the pilot-operated check valves 12*a* and 12*b* of all the outrigger cylinders 11FL, 11FR, 11RL and 11RR via the pipeline 32, enabling the pilot-operated check valves 12*a* and 12*b* to function as open valves. As a result, the operations of all the outrigger cylinders 11 become enabled. In addition, the pilot pressure from the hydraulic source 28 is also applied to the directional control valve 22 to switch the directional control valve 22 to the position "a" or the position "b". Consequently, the pressure oil from the hydraulic pump 21 is guided to the bottom chambers 11*a* or the rod chambers 11*b* of the outrigger cylinders 11FL, 11FR, 11RL and 11RR and is discharged from the rod chambers 11*b* or the bottom chambers 11*a*. Thus, all the outrigger cylinders 11 are simultaneously driven to jack up/down the entire vehicle body.

In order to operate a single outrigger cylinder (e.g., 11FL) independently, on the other hand, the front/rear selector switch 41 is operated to the F position and the left/right selector switch 42 is operated to the L position. Through these switch operations, an allow extension/contraction command for the outrigger cylinder 11FL and a prohibit extension/contraction command for the outrigger cylinders 11FR, 11RL and 11RR are output. As a result, the solenoid 34*a* is excited, the solenoid controlled directional control valve 34 is switched to the position "a" and thus, the operation of the outrigger cylinder 11FL is enabled. As the operation lever 26 currently at the neutral position is operated in this state, the pilot pressure is applied to the pilot-operated check valves 12*a* and 12*b* of the outrigger cylinder 11FL and the outrigger cylinder 11FL can be driven by itself with the pressure oil from the hydraulic pump 21. Likewise, an independent operation of the outrigger cylinder 11FR is enabled by operating the front/rear selector switch 41 to the F position and the left/right selector switch 42 to the R position, an independent operation of the outrigger cylinder 11RL is enabled by operating the front/rear selector switch 41 to the R position and the left/right selector switch 42 to the L position, and an independent operation of the outrigger cylinder 11RR is enabled by operating the front/rear selector switch 41 to the R position and the left/right selector switch 42 to the R position.

In order to operate a pair of outrigger cylinders (e.g., 11FL and 11FR) simultaneously, the front/rear selector switch 41 is operated to the F position and the left/right selector switch 42 is operated to the A position. Through the switch operations, the solenoids 34*a* and 35*a* become excited and the solenoid controlled directional control valves 34 and 35 are each switched to the position "a", thereby enabling the operations of the outrigger cylinders 11FL and 11FR. As the operation lever 26 currently at the neutral position is operated in this state, the pilot pressure is applied to the pilot-operated check valves 12*a* band 12*b* of the outrigger cylinders 11FL and 11FR, and the front-side outrigger cylinders 11FL and 11FR of the vehicle can be driven at the same time with the pressure oil from the hydraulic pump 21. Likewise, the rear-side outrigger cylinders 11RL and 11RR of the vehicle can be engaged in simultaneous operations by operating the front/rear selector switch 41 to the R position and the left/right selector switch 42 to the A position, the left-side outrigger cylinders 11FL and 11RL of the vehicle can be engaged in simultaneous operations by operating the front/rear selector switch 41 to the A position and the left/right selector switch 42 to the L position, and the right-side outrigger cylinders 11FR and 11RR of the vehicle can be engaged in simultaneous operations by operating the front/rear selector switch 41 to the A position and the left/right selector switch 42 to the R position.

Figure 7:
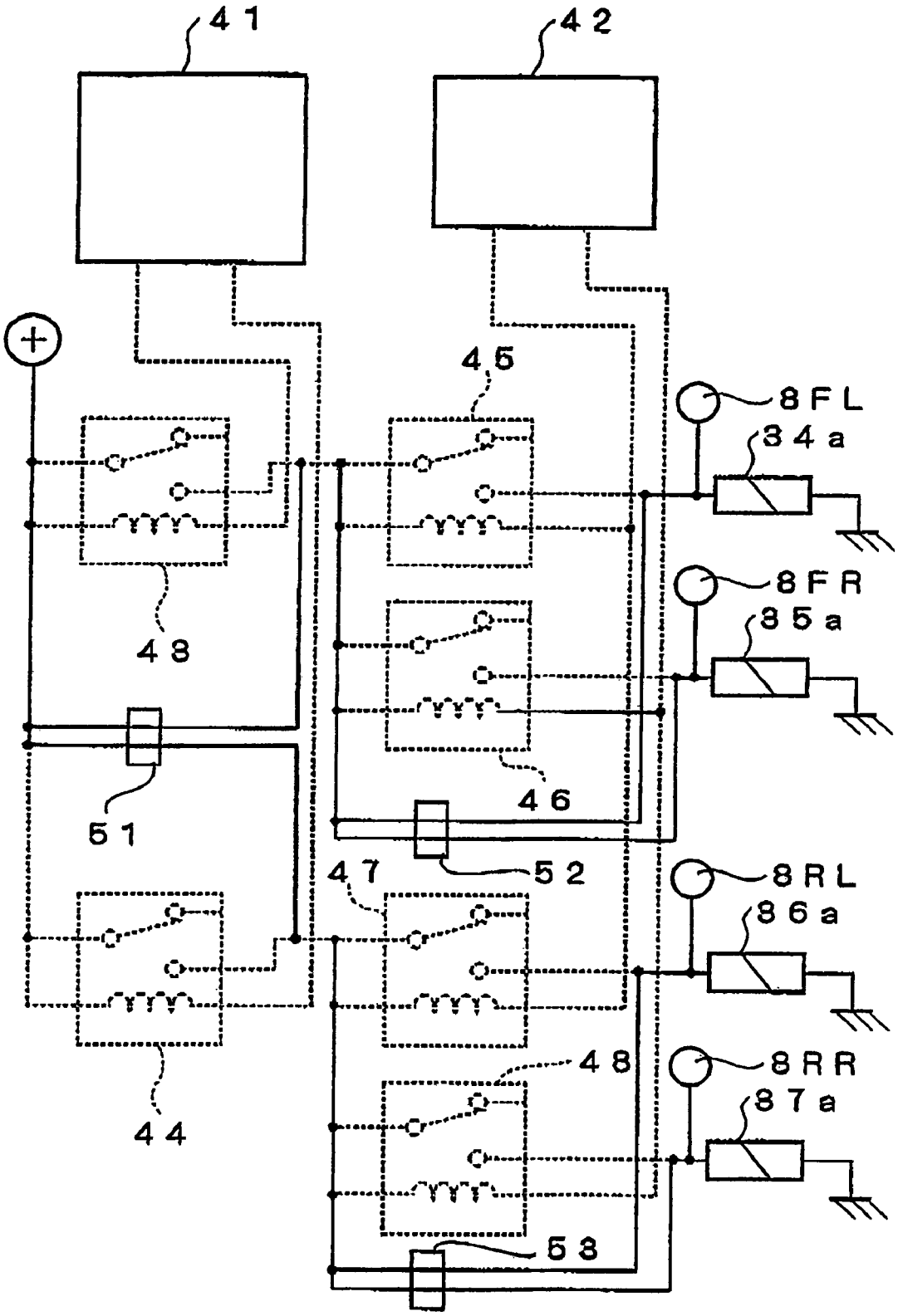
FIG. 7 illustrates an operation of the relay circuit shown in FIG. 4.

The operations of the outrigger cylinders 11 may also be enabled by turning on the switches 51 to 53 as described below. As the switches 51 to 53 are turned on, the solenoids 34*a* to 37*a* are all excited, as shown in FIG. 7. As a result, the operations of all the outrigger cylinders 11 are enabled, regardless of how the switches 41 and 42 are operated. In addition, if the front/rear selector switch 41 is operated to the F position or the R position while the switch 52 or 53 is in an ON state, the solenoids 34*a* and 35*a* or the solenoids 36*a* and 37*a* become excited regardless of how the left/right selector switch 42 is operated. Thus, a pair of outrigger cylinders either on the front side or the rear side, 11FL and 11FR or 11RL and 11RR, can be engaged in operation at the same time. If the left/right selector switch 42 is operated to the L position or the R position while the switch 51 is in an ON state, the solenoids 34*a* and 36*a* or the solenoids 35*a* and 37*a* become excited. As a result, a pair of outrigger cylinders either on the left side or the right side, 11FL and 11FL or 11FR and 11RR, can be engaged in operation at the same time.

The following advantages can be achieved in the embodiment.

(1) The pilot-operated check valves 12*a* and 12*b* are disposed on the intake side of the bottom chamber 11*a* and the rod chamber 11*b* of each of the outrigger cylinders 11FL, 11FR, 11RL and 11RR, and the solenoid controlled directional control valves 34 to 37 are switched in response to operations of the front/rear selector switch 41 and the left/right selector switch 42 to allow pressure oil to flow out from the corresponding oil chambers 11*a* and 11*b*. This facilitates the selection of a given outrigger cylinder among the outrigger cylinders 11FL, 11FR, 11RL and 11RR to engage in operation independently of the others and the selection of a plurality of outrigger cylinders 11 to engage in simultaneous operation.

(2) The front/rear selector switch 41 and the left/right selector switch 42 are each constituted as a dial switch, the front/rear selector switch 41 is used to select operations of the front-side/rear-side outrigger cylinders 11 and the left/right selector switch 42 is used to select operations of the left side/right-side outrigger cylinders 11. Thus, if simultaneous operations of all the outrigger cylinders 11FL, 11FR, 11RL and 11RR and an independent operation of a single outrigger cylinder (e.g., 11FL) are to be alternately executed, for instance, the switches 41 and 42 should first each be operated to the A position and then they should be operated to the F position and the L position respectively. Since the switches 41 and 42 need to be operated only a few times, the selection procedure is simplified.

(3) The solenoids 34*a* to 37*a* can all be demagnetized by operating the front/rear selector switch to the OFF position, and thus, all the outrigger cylinders 11 can be set in a non-operating state at once with ease.

(4) The relay circuit can be short-circuited by using the switches 51 to 53 included therein and as a result, the outrigger cylinders 11 can be engaged in operation selectively regardless of how the switches 41 and 42 are operated.

(5) Since each operation-enabled outrigger cylinder 11 is indicated as the corresponding lamp 8FL, 8FR, 8RL or 8RR becomes lit, the operator can verify the operation-enabled outrigger cylinder 11 and thus, an erroneous operation of the outrigger cylinders 11 can be prevented.

(6) The pressure oil from the hydraulic pump 21 is guided to the undercarriage 1 via the pair of pipeline 23 and 24 and the pilot pressure from the hydraulic source 28 is guided to the undercarriage 1 via the single pilot pipeline 32. Thus, the number of pipelines passing through the center joint 25 is reduced to achieve miniaturization of the center joint 25.

(7) Since the pilot pressure is supplied to the directional control valve 22 and the pilot-operated check valves 12*a* and 12*b* in response to an operation of the operation lever 26, the pilot-operated check valves 12*a* and 12*b* are engaged in operation by interlocking with the operation of the operation lever 26. Since this prevents any undesirable movement of the outrigger cylinders 11 immediately after the solenoid controlled directional control valves 34 to 37 are switched in response to switch operations, the reliability of the outriggers 10 is improved.

Figure 8:
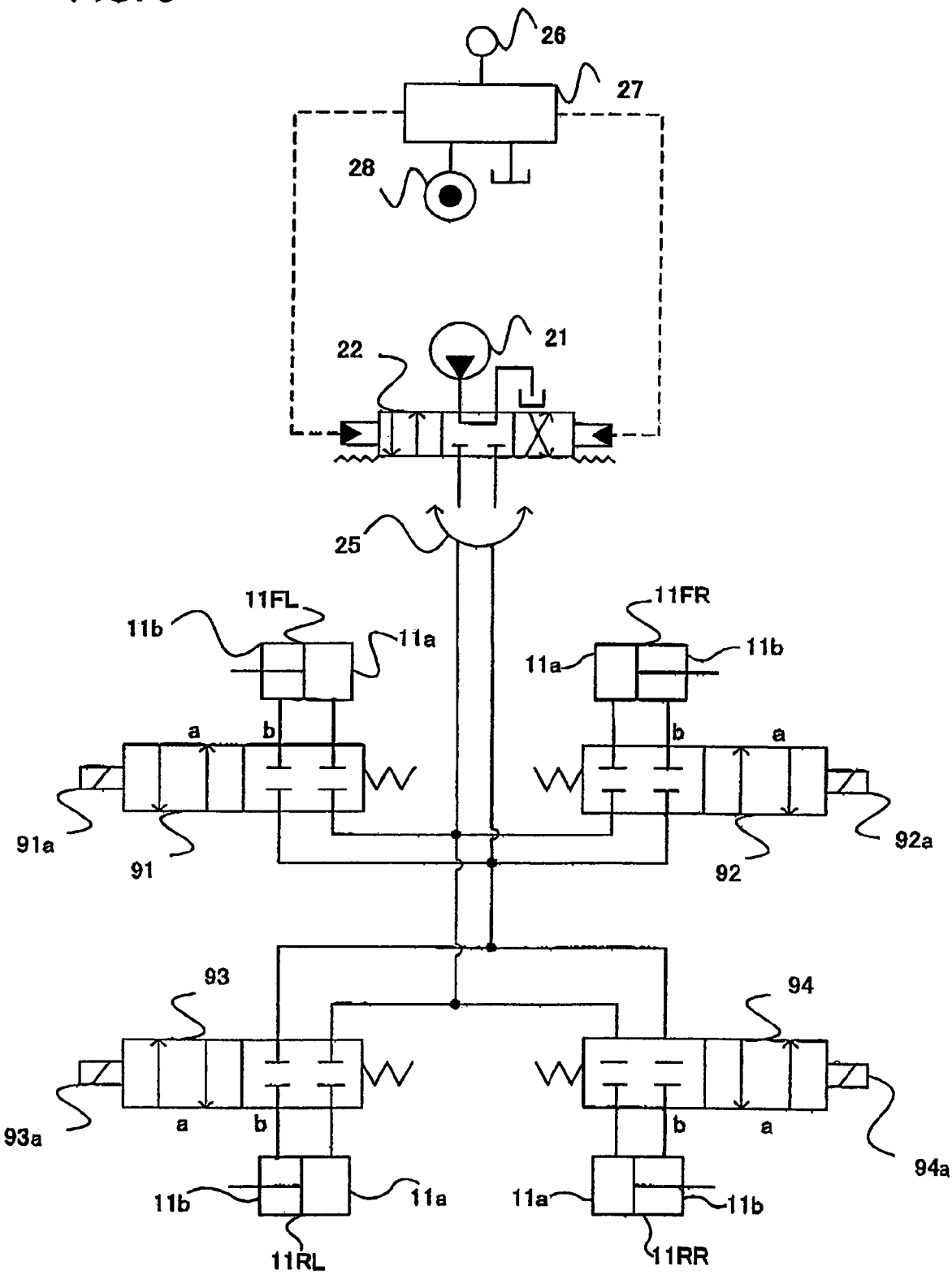
FIG. 8 shows a variation of the hydraulic circuit in FIG. 3.
Figure 9:
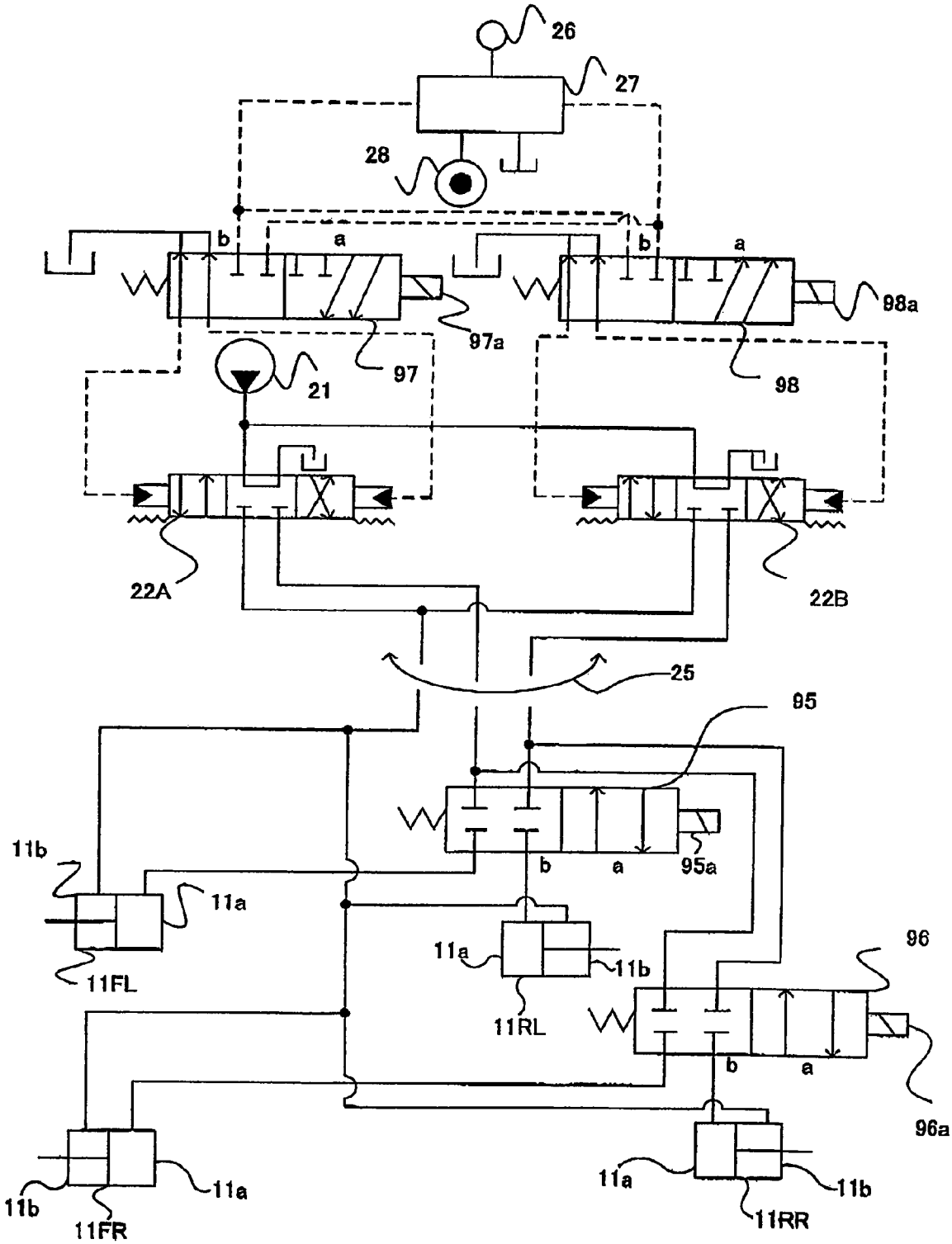
FIG. 9 shows yet another variation of the hydraulic circuit in FIG. 3.

It is to be noted that a hydraulic circuit, i.e., a pressure oil control means, other than that described above may be used to engage a single outrigger cylinder 11 in independent operation or to engage a plurality of outrigger cylinders 11 in operation simultaneously. FIGS. 8 and 9 show hydraulic circuit diagrams of alternative hydraulic circuits that may be adopted in conjunction with the outrigger cylinders 11. In FIGS. 8 and 9, the same reference numerals are assigned to components identical to those in FIG. 3.

FIG. 8 shows solenoid controlled directional control valves 91 to 94 disposed on the intake side of the oil chambers 11*a* and 11*b* respectively of the outrigger cylinders 11FL, 11FR, 11RL and 11RR. It is to be noted that the solenoid controlled directional control valves 91 to 94 may each be a solenoid controlled directional control valve having a check valve. Solenoids 91*a* to 94*a* of the solenoid controlled directional control valves 91 to 94 are connected to a relay circuit similar to that shown in FIG. 4 and are excited in response to operations of the switches 41 and 42, as explained earlier.

Namely, if the vehicle body is not to be jacked up/down, for instance, the front/rear selector switch 41 is operated to the OFF position. As a result, the solenoids 91*a* to 94*a* are all demagnetized, switching all the solenoid controlled directional control valves 91 to 94 to the position "b". Thus, the flow of the pressure oil to the oil chambers 11*a* and 11*b* of all the outrigger cylinders 11FL, 11FR, 11RL and 11RR is stopped, and a jack up/down operation is prohibited. In order to jack up/down the entire vehicle body, the front/rear selector switch 41 and the left/right selector switch 42 are both operated to the A position. In response, all the solenoids 91*a* to 94*a* become excited and the solenoid controlled directional control valves 91 to 94 are each switched to the position "a". As a result, the flow of the pressure oil to the oil chambers 11*a* and 11*b* of all the outrigger cylinders 11FL, 11FR, 11RL and 11RR is allowed, enabling a jack up/down operation of the entire vehicle body in response to an operation of the operation lever 26. In addition, when a single outrigger cylinder (e.g., 11FL) is to be operated independently, the front/rear selector switch 41 is operated to the P position and the left/right selector switch 42 is operated to the L position. In response, the solenoid 91*a* becomes excited and the solenoid controlled directional control valve 91 is switched to the position "a", enabling an independent operation of the single outrigger cylinder 11FL. When a pair of outrigger cylinders (e.g., 11FL and 11FR) are to be operated at once, the front/rear selector switch 41 is operated to the F position and the left/right selector switch 42 is operated to the A position. In response, the solenoids 91*a* and 92*a* become excited and the solenoid controlled directional control valves 91 and 92 are each switched to the position "a", thereby enabling simultaneous operations of the pair of outrigger cylinders 11FL and 11FR.

In FIG. 9, a pair of directional control valves 22A and 22B are disposed in parallel relative to the hydraulic pump 21, the pressure oil from the directional control valve 22A is guided to the front-side outrigger cylinders 11FL and 11FR of the vehicle and the pressure oil from the directional control valve 22B is guided to the rear-side outrigger cylinders 11RL and 11RR of the vehicle. The directional control valves 22A and 22B are respectively driven by solenoid controlled directional control valves 97 and 98. A solenoid controlled directional control valve 95 is connected to the oil chambers 11*a* of the left-side outrigger cylinders 11FL and 11RL of the vehicle, whereas a solenoid controlled directional control valve 96 is connected to the oil chambers 11*a* of the right-side outrigger cylinders 11FR and 11RR of the vehicle.

Figure 10:
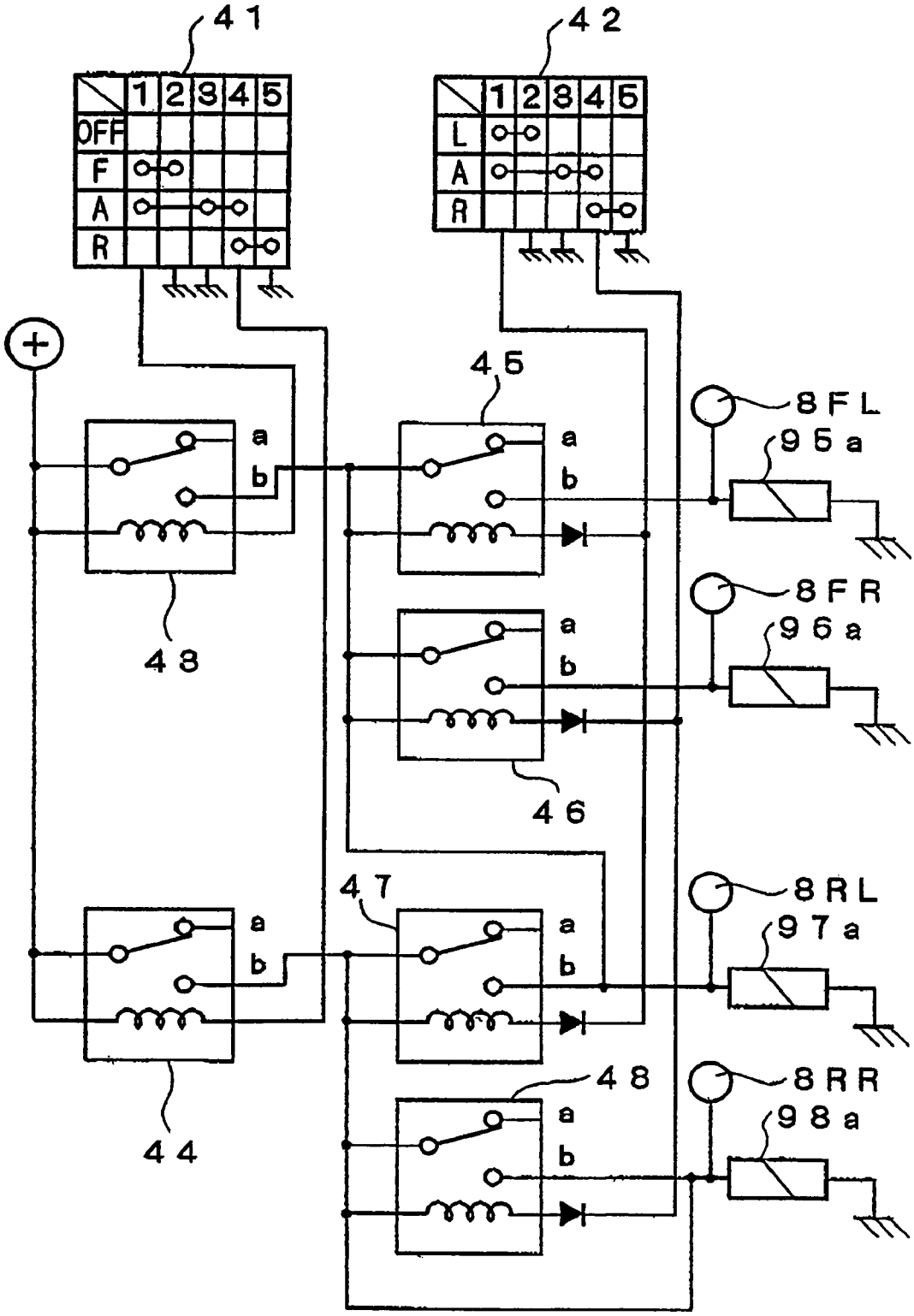
FIG. 10 shows a relay circuit that controls the solenoid controlled directional control valves in FIG. 8.

Solenoids 95*a* to 98*a* of the solenoid controlled directional control valves 95 to 98 are connected to a relay circuit shown in FIG. 10. The relay circuit in FIG. 10 differs from the relay circuit in FIG. 4 in that the contact point. "b" at the relay 43 and the contact point "b" at the relay 44 are respectively short-circuited from the solenoids 97*a* and 98*a*. Accordingly, as the front/rear selector switch 41 is operated to the F position and the R position, the solenoids 97*a* and 98*a* respectively are excited, regardless of the position of the left/right selector switch 42. As the front/rear selector switch 41 is operated to the A position, the solenoids 97*a* and 98*a* are excited regardless of the position of the left/right selector switch.

For instance, if the vehicle body is not to be jacked up/down, the front/rear selector switch 41 is operated to the OFF position. As a result, the solenoids 95*a* to 98*a* are all demagnetized, switching all the solenoid controlled directional control valves 95 to 98 to the position "b". Thus, the flow of the pressure oil to all the outrigger cylinders 11L, 11FR, 11RL and 11RR is stopped, and a jack up/down operation is prohibited. In order to jack up/down the entire vehicle body, the front/rear selector switch 41 and the left/right selector switch 42 are both operated to the A position. In response, all the solenoids 95*a* to 98*a* become excited and the solenoid controlled directional control valves 95 to 98 are each switched to the position "a". As a result, the flow of the pressure oil to all the outrigger cylinders 11FL, 11FR, 11RL and 11RR is allowed, enabling a jack up/down operation of the entire vehicle body in response to an operation of the operation lever 26. In addition, when a single outrigger cylinder (e.g., 11FL) is to be operated independently, the front/rear selector switch 41 is operated to the F position and the left/right selector switch 42 is operated to the L position. In response, the solenoids 95*a* and 97*a* become excited and the solenoid controlled directional control valves 95 and 97 are each switched to the position "a". In this state, the pressure oil is allowed to flow to the outrigger cylinder 11FL, enabling an independent operation of the outrigger cylinder 11FL. When a pair of outrigger cylinders (e.g., 11FL and 11FR) are to be operated at once, the front/rear selector switch 41 is operated to the F position and the left/right selector switch 42 is operated to the A position. In response, the solenoids 95*a* to 97*a* become excited and the solenoid controlled directional control valves 95 to 97 are each switched to the position "a". In this state, the pressure oil is allowed to flow to the outrigger cylinders 11FL and 11 FR, thereby enabling simultaneous operations of the outrigger cylinders 11FL and 11FR.

It is to be noted that while the switches 41 and 42 used to select operations of the outrigger cylinders 11 are each constituted as a dial switch in the embodiment described above, they may instead be push-button switches.

While the outriggers 10 are mounted at the front and the rear of the vehicle body both on the left side and the on the right side in the embodiments described above, the present invention may be adopted with equal effectiveness in a vehicle having outriggers only on either the front side or the rear side (e.g., only on the rear side) of the vehicle body. In such a case, since only the rear-side outrigger cylinders 11RL and 11RR need to be operated, the front/rear selector switch 41 does not need to be installed.

While an explanation is given above in reference to the embodiments on selective operations of the outrigger cylinders 11, the present invention may be adopted when selectively operating a plurality of work hydraulic cylinders of a type different from outrigger cylinders, such as blade cylinders.

While all the outrigger cylinders 11 are set in a non-operating state by operating the front/rear selector switch 41 to the OFF position, an OFF switch may be installed in addition to the front/rear selector switch 41 so as to set all the outrigger cylinders 11 in a non-operating state by operating this switch.

A drive command for the directional control valve 22 may be issued through an operating member (e.g., a switch) other than the operation lever 26.

While the power supply to the solenoids 34*a* to 37*a* and 61*a* to 64*a* is controlled through a relay circuit, signals from the operation lever 26 and the switches 41 and 42 may be taken into a computer to enable computer control.

While the switches 51 to 53 are used to short-circuit the pair of relays 43 and 44, the pair of relays 45 and 46 and the pair of relays 47 and 48, switches may be installed to be used to short-circuit the individual relays 43 to 48.

INDUSTRIAL APPLICABILITY

While an explanation is given above on an example in which the present invention is adopted in a wheel hydraulic excavator, the present invention may be adopted in other types of work vehicles including construction machines such as wheel loaders and truck cranes, as well. It may also be adopted in conjunction with jack-up cylinders for large cranes and in conjunction with cylinders used to extend/contract a side frame.

The invention claimed is:

1. A drive device of work hydraulic cylinders, comprising:

a hydraulic source;

at least a plurality of work hydraulic cylinders of a single type, that are to be driven with pressure oil from the hydraulic source;

a control valve that controls a flow of pressure oil from the hydraulic source to the work hydraulic cylinders;

an operating device that issues a command for drive of the control valve;

a selector switch that selects at least an independent operation of the work hydraulic cylinders; and a pressure oil control device that allows the pressure oil to flow to a work hydraulic cylinder selected with the selector switch and disallowing flow of pressure oil to other work hydraulic cylinders;

wherein at least one of the work hydraulic cylinders selected with the selector switch is driven in response to the command issued from the operating device, after the pressure oil is allowed to flow to the at least one of the work hydraulic cylinders selected, by the pressure oil control device.

2. A drive device of work hydraulic cylinders according to claim 1, wherein the work hydraulic cylinders are outrigger cylinders mounted on a left side and a right side of a vehicle and the selector switch selects an independent operation of one of a left-side outrigger cylinder and a right-side outrigger cylinder or simultaneous operations of the left-side outrigger cylinder and the right-side outrigger cylinder.

3. A drive device of work hydraulic cylinders according to claim 2, wherein the work hydraulic cylinders are outrigger cylinders mounted also on a front side and a rear side of the vehicle, and the selector switch selects an independent operation of one of a front-side outrigger cylinder and a rear-side outrigger cylinder or simultaneous operations of the front-side outrigger cylinder and the rear-side outrigger cylinder.

4. A drive device of work hydraulic cylinders according to claim 2, wherein all the outrigger cylinders can be set in a non-operating state with the selector switch.

5. A drive device of work hydraulic cylinders according to claim 1, further comprising a switching device that allows a selection of operations of the work hydraulic cylinders regardless operations of the selector switch.

6. A drive device of work hydraulic cylinders according to claim 1, further comprising a display device at which an operation-enable work hydraulic cylinder is indicated.

7. A drive device of work hydraulic cylinders, comprising:

a hydraulic source;

outrigger cylinders mounted at front and rear of a vehicle on a left side and a right side, that are to be driven with pressure oil from the hydraulic source;

a control valve that controls a flow of pressure oil from the hydraulic source to the outrigger cylinders;

an operating device that issues a command for drive of the control valve;

a first selector switch that selects an independent operation of one of a left-side outrigger cylinder and a right-side outrigger cylinder or simultaneous operations of the left-side outrigger cylinder and the right-side outrigger cylinder;

a second selector switch that selects an independent operation of one of a front-side outrigger cylinder and a rear-side outrigger cylinder or simultaneous operations of the front- side outrigger cylinder and the rear-side outrigger cylinder; and a pressure oil control device that allows the pressure oil to flow to an outrigger cylinder selected with the first selector switch and the second selector switch and disallowing flow of the pressure oil to other outrigger cylinders;

wherein at least one of the outrigger cylinders selected with at least one of the first selector switch and the second selector switch is driven in response to the command issued from the operating device, after the pressure oil is allowed to flow to the at least one of the outrigger cylinders selected, by the pressure oil control device.

* * * * *